US011047133B1

(12) United States Patent
Barton

(10) Patent No.: US 11,047,133 B1
(45) Date of Patent: Jun. 29, 2021

(54) MODULAR ROOFTOP WITH VARIABLE SLOPE PANELS

(71) Applicant: Airbnb, Inc., San Francisco, CA (US)

(72) Inventor: Christopher Perry Barton, San Francisco, CA (US)

(73) Assignee: Airbnb, Inc., San Francisco, CA (US)

( * ) Notice: Subject to any disclaimer, the term of this patent is extended or adjusted under 35 U.S.C. 154(b) by 0 days.

(21) Appl. No.: 16/717,990

(22) Filed: Dec. 17, 2019

(51) Int. Cl.

| | |
|---|---|
| ***E04C 3/00*** | (2006.01) |
| ***E04D 3/366*** | (2006.01) |
| ***E04D 3/24*** | (2006.01) |
| ***E04B 7/20*** | (2006.01) |

(52) U.S. Cl.
CPC ..... *E04D 3/366* (2013.01); *E04B 7/20* (2013.01); *E04D 3/24* (2013.01)

(58) Field of Classification Search
CPC ..... E06F 10/08; F24S 20/69; E04D 13/00; E04D 13/174; E04D 13/032; E04D 13/031; E04D 13/0305; E04D 13/0315; E04D 3/00; E04D 1/12; E04D 1/2918; E04D 3/16; E04D 2001/3461; E04D 2003/085; E04D 2001/3447; E04D 2001/3494
USPC ..... 52/588.1, 745.06, 747.1, 746.11, 302.1, 52/198, 506.01, 199, 97, 525, 556, 538, 52/527, 557, 200, 203, 465, 802.1
See application file for complete search history.

(56) References Cited

U.S. PATENT DOCUMENTS

| | | | | |
|---|---|---|---|---|
| 2,168,218 | A * | 8/1939 | Kirschbraun | E04D 1/22 52/560 |
| 4,548,006 | A * | 10/1985 | Roberts, Sr. | E04D 13/03 52/200 |
| 4,975,647 | A * | 12/1990 | Downer | G01N 35/00663 324/425 |
| 5,561,953 | A * | 10/1996 | Rotter | E04D 3/30 454/365 |
| 5,791,092 | A * | 8/1998 | Strieter | E04D 13/031 248/237 |
| 6,151,838 | A * | 11/2000 | Husein | E04D 13/02 52/200 |
| 6,343,439 | B1 * | 2/2002 | Rutledge | E04D 13/1471 248/148 |
| 6,581,337 | B1 * | 6/2003 | Skov | E04B 1/34315 52/79.5 |
| 6,966,157 | B1 * | 11/2005 | Sandow | E04D 3/362 52/200 |
| 7,331,150 | B2 * | 2/2008 | Martinique | E04D 1/20 52/520 |
| 7,721,493 | B2 * | 5/2010 | Skov | E04D 3/32 52/200 |

(Continued)

*Primary Examiner* — Chi Q Nguyen
(74) *Attorney, Agent, or Firm* — Maynard Cooper & Gale, P.C.; Jon E. Holland, Esq.

(57) ABSTRACT

In a roofing structure, two roof panels with different slopes and lengths are positioned back-to-back, the vertical back walls of the panels having a uniform height. The seam between the two differently-sloped panels are connected by a ridge cap set at a uniform height. The ridge cap covers the seam, extending on both sides to a distance from the back walls of the roof panels sufficient to create a capillary break therefrom (preventing moisture migration) and then downwards and slightly towards the back walls of the roof panels, thereby using gravity to direct the water into the downward sloping roof panels.

17 Claims, 10 Drawing Sheets

(56) References Cited

U.S. PATENT DOCUMENTS

| | | | | |
|---|---|---|---|---|
| 7,797,885 | B2 * | 9/2010 | Mower | E04D 3/40 52/79.6 |
| 8,438,798 | B2 * | 5/2013 | McLain | E04D 3/30 52/200 |
| 9,022,845 | B2 * | 5/2015 | Henderson | F24F 7/02 454/250 |
| 9,637,927 | B2 * | 5/2017 | Pendley | E04D 3/352 |
| 9,745,938 | B2 * | 8/2017 | Stahr | F02M 21/0278 |
| 9,951,523 | B1 * | 4/2018 | Collins | E04D 3/35 |
| 2002/0180404 | A1 * | 12/2002 | Benn | H02J 7/35 320/101 |
| 2004/0163328 | A1 * | 8/2004 | Riley | E04B 7/22 52/82 |
| 2005/0005537 | A1 * | 1/2005 | Houk, Jr. | E04B 7/022 52/127.6 |
| 2006/0240762 | A1 * | 10/2006 | Railkar | F24F 7/02 454/260 |
| 2012/0011798 | A1 * | 1/2012 | Rivellino | E04B 1/4157 52/655.1 |
| 2016/0145872 | A1 * | 5/2016 | Anderson | E04D 3/362 52/588.1 |
| 2016/0194876 | A1 * | 7/2016 | Faigen | E04B 5/48 52/302.1 |

* cited by examiner

MODULAR ROOFTOP WITH VARIABLE SLOPE PANELS

BACKGROUND

Roofing structures for residential, commercial, and/or public properties are designed to protect an above-ground structure from damaging elements, such as wind or rain. A roof may include an underlayment, a water-resistant or waterproof barrier material that is installed directly underneath one or more other roofing elements to prevent water intrusion in case of severe weather. One conventional type of underlayment uses thermoplastic polyolefin (TPO) laid down in large sheets. The TPO sheets become plastic upon heating and harden upon cooling, thereby welding the multiple sheets together to seal at the seams. In other conventional applications, sealants can be applied to close or secure the seams between sheeting. These large sheets may be arranged at an upward angle, positioned at a positive slope with a highest point at the center of the roof. In such a configuration, due to gravity, water on a roof will eventually drain off to the lowest point.

Because leakage is possible at any joint in the roofing of a building, roofing structures must be customized to a building, where buildings with unique sizes or layouts may need roofing sheets cut to size for the particular building. What is more, traditionally, roofing is installed so as to be permanently affixed at the top of a constructed building. Once set in place, these conventional roofs cannot be easily removed, altered, or relocated, for example, in circumstances where a property owner wishes to modify or remove a building.

Figure 1:
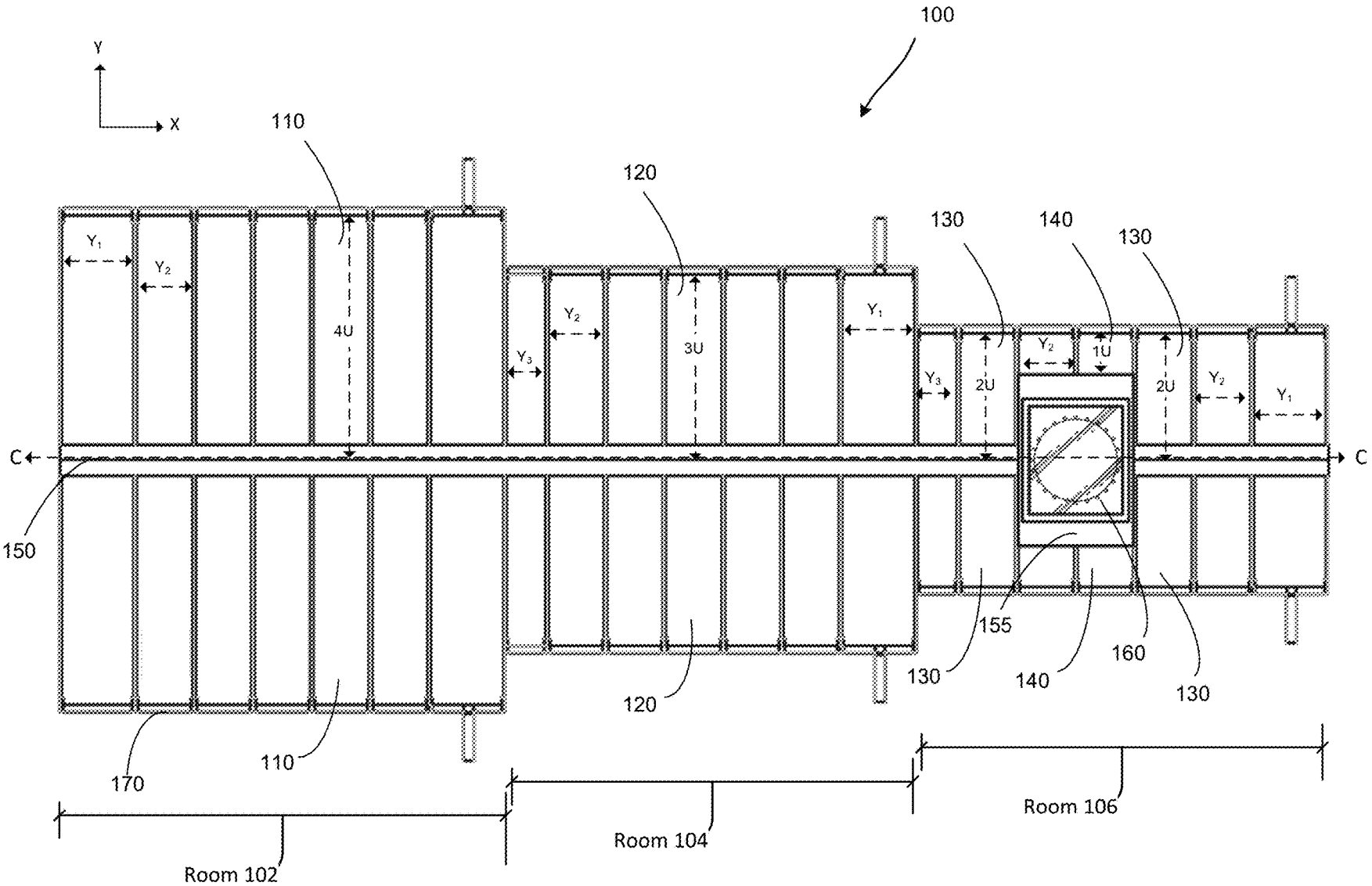
FIG. 1 is an overhead view of a roof in accordance with some embodiments of the present disclosure.

In the figures, the left-most digit(s) of a reference number identifies the figure in which the reference number first appears. The use of the same reference numbers in different figures indicates similar or identical items or features. Moreover, multiple instances of the same part are designated by a common prefix separated from the instance number by a dash. The drawings are not to scale.

DETAILED DESCRIPTION

The present disclosure is directed to a modular roofing structure. Rather than sealants, the structure uses geometry to create spaces into which water cannot pass, while being reusable with modular housing that may have differently-shaped roof requirements. In an exemplary embodiment, two roof panels with different slopes and different lengths are positioned back-to-back, the vertical back walls of the respective panels having a uniform height. The seam between the two differently-sloped panels, the seam being where they connect at their respective vertical back walls, is bridged and connected by a ridge cap that is positioned at a uniform height.

In an exemplary embodiment, a rooftop panel (alternatively referred to as a roofing panel or roof block) comprises a pan to collect and expel water. The pan may include a lower panel having a sloped surface with a high and low end, and two vertical side walls. In some embodiments, the high end of the panels end at a same, uniform height with respect to the roof base or roof beam. The roof panels may be arranged so as to be horizontally adjacent (side to side) or vertically adjacent (back to back) to another panel, regardless of the panels' respective length(s) or slope(s). Accordingly, a roof panel may typically be adjacent to 1-3 other panels.

In an exemplary embodiment, the back of each panel is arranged against a central axis, such that a single virtual "midline" can be drawn down the entire roofing structure. A ridge cap (or other type of capping structure such as a gasketed gap) is arranged as a single piece over the virtual midline, so as to cover the seam between the panels when they are arranged back to back. An exemplary ridge cap is a single bent piece of metal that functions as a geometric cover, held in place by geometry and friction, that utilizes gravity to prevent water from entering into the covered area, where water might otherwise enter through a seam or join of two other components or another point of entry.

In one embodiment, the ridge cap covers the seam from above with a non-flat surface. The ridge cap then extends on both sides to a distance from the back walls of the roof panels sufficient to create a capillary break between the ridge cap and the back wall. This capillary break prevents moisture migration from water on the ridge cap into the seam. In one embodiment, the ridge cap then continues downwards (towards the bottom of the roof) and slightly towards the back walls of the roof panels (towards the center of the roof), using gravity to direct the water into the pans of the downward sloping roof panels and, ultimately, to a gutter.

In an exemplary embodiment, a ridge cap extends along the entirety of the virtual midline, that is, along the entirety of the seams between the end-to-end pairs of panels. Each panel in each pair of panels has a back end positioned at the same z-axis position (height), so that the ridge cap extends across the same relative height. Each panel in each pair of panels may also have their front ends (the lower end of the sloped panel leading to the gutter) positioned at the same height, typically less than the height at the panels at their highest point in the back.

In the exemplary embodiment, the slope of each roof panel is positive and non-zero to encourage the flow of water to the gutter. Because the length of the panels may vary, the slope of the bottom sheet of the panel also varies, that is, shorter panels must be sloped at a steeper angle to reach the same starting and ending heights as longer panels.

Conventional methods for sealing a roof commonly use sheets of thermoplastic polyolefin that become plastic upon heating and harden upon cooling, through which process the sheets are welded together to seal at the seams. In other conventional applications, sealants can be applied to close or secure the seams of sheeting. Still other known methods attempt to use "natural" solutions to take advantage of the way water can't get into spaces, such as air gaps, or sealing methods based on geometry rather than liquids, sealants, or large cut to size sheets.

By virtue of the systems and methods described herein, in contrast to the conventional methods, a single ridge cap can be used to effectively seal adjacent panels that may vary in length and/or slope. Unlike conventional standing seam roofs, the roofing structures described herein do not set out any excessive slope requirements. Rather, the exemplary roofing structure can in some embodiments be almost flat, serving, in a small package, to drain all the water away from the top of the building. Accordingly, regardless of a building's existing roof slope or arrangement, the solutions described herein can be applied in a highly flexible manner to any roofing structure for which a virtual "midline" can be defined.

What is more, the solutions described herein are non-permanent or semi-permanent. Therefore, compared to conventional solutions that result in one-time use material and wasted product, the roofing system described herein is removable. Rather than use cut-to-size parts per traditional construction, a modular roofing system, including the ridge cap, gutters, scuppers, and the like can be removed without detrimental effect to the component parts. Because of the removability of the roofing, and the flexibility in its application to differently shaped and sloped roofs, the exemplary roofing structure described herein is modular, made up of all (or virtually all) reusable components. As a result, the exemplary roof seal uses no extra parts to eliminate water seepage, while keeping a structure that can be disassembled without damage.

FIG. 1A depicts a top-down view of one embodiment of a roof 100. The illustrated roof 100 covers three rooms 102, 104, 106. In the illustrated embodiments, each room is covered by a plurality of pairs of roof panels having a variety of different lengths. Dimensions of different panels of roof 100 may vary, and are described herein based on respective integer multiples of a variable U, representing a standard multiple by which the structure may be measured. For instance, in one embodiment, the U value is equal to 600 mm, while in other embodiments, the roof may have a structure that is based on other unit quantities, for example, a U value of 500 mm, or any other appropriate value.

From left to right, roof 100, at the portion covering room 102 (the largest room), includes a plurality (here, 7) of pairs of vertically adjacent (back to back) roof panels 110, each panel covering a vertical distance (y-axis distance) of 4U (also referred to herein as 4U panels). More particularly, the 4U panel may not itself necessarily be 4U in length, but is designed to cover a distance of 4U of the rooftop, although the particular size of the panel may vary in different embodiments, and may include a length of 4U. Roof 100, at the portion covering room 104 (the middle room), includes a plurality (here, 7) of pairs of vertically adjacent (back to back) roof panels 120, each panel covering a vertical distance of 3U (also referred to herein as 3U panels). At the portion of roof 100 covering room 106 (the smallest room), roof 100 includes a plurality (here, 5) pairs of vertically adjacent (back to back) roof panels 130, each covering a vertical distance of 2U (also referred to herein as 2U panels) and a plurality (here, 2) pairs of vertically-adjacent (back to back) roof panels 140, each covering a vertical distance of 1U (also referred to herein as 1U panels). In the illustrated embodiment, the panels 110, 120, 130, and 140 need not have a set horizontal distance (x-axis) distance, and indeed, exemplary FIG. 1 illustrates three widths $Y_1$, $Y_2$, and $Y_3$. As can be seen, roof 100 uses nine different types of uniquely-sized roof panels, differing in at least one of height and width. Of course, the above is simply exemplary, and in other embodiments, any number, size, or arrangement of rooms, and/or any number or configuration of panels may be used. In some embodiments, the entirety of the building below is covered by the roof 100, and in other embodiments, only a subset of the area of the building below may be covered (for example in the case of an uncovered patio, courtyard, atrium, or the like).

Figure 11:
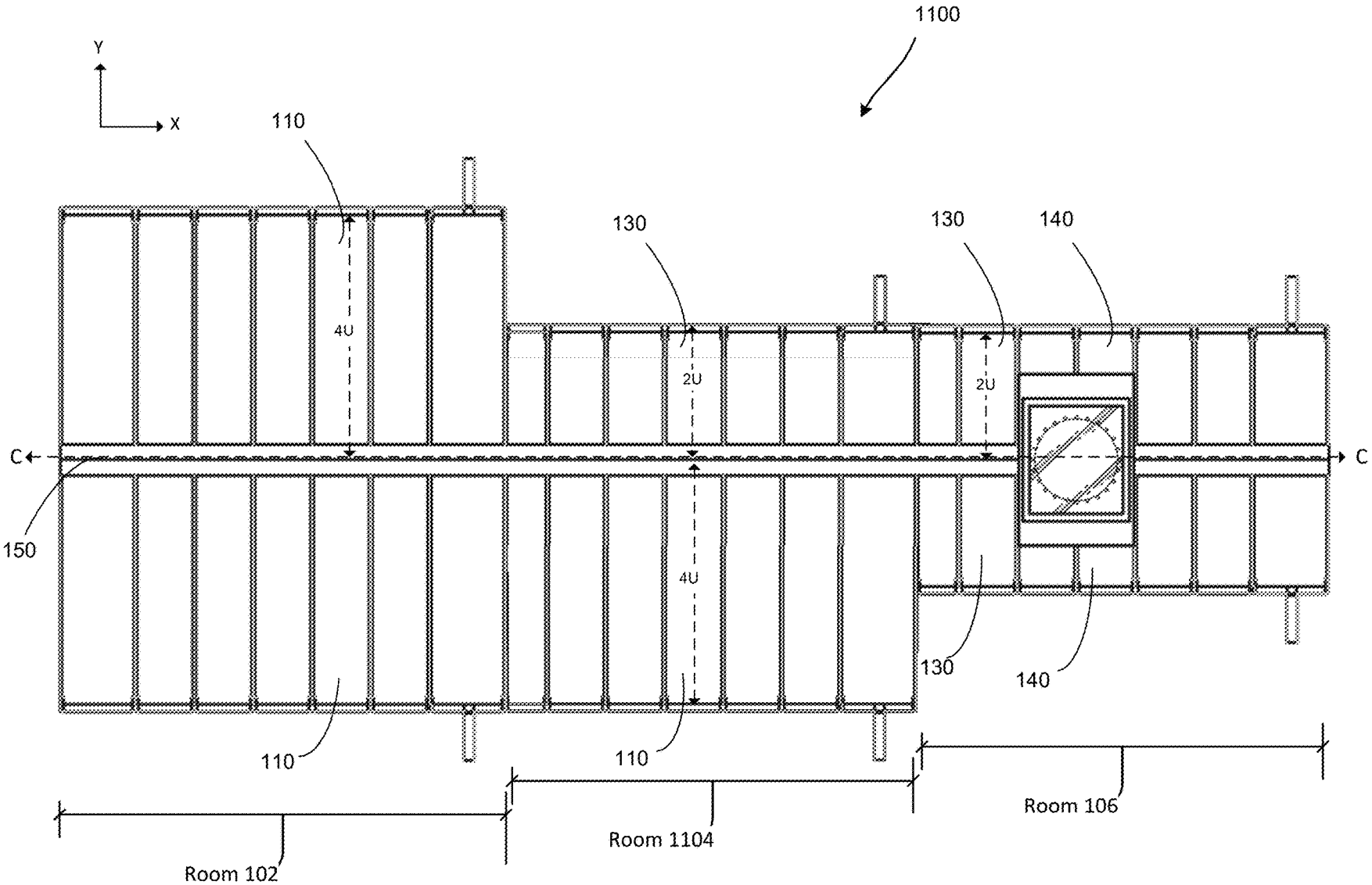
FIG. 11 is an overhead view of a roof in accordance with some embodiments of the present disclosure.

A ridge cap 150 runs along the length of the roof 100 in an x-axis direction, positioned over the seams between each of the pairs of vertically-adjacent panels. The ridge cap 150 runs axially with a midline axis C-C. The three rooms 102, 104, and 106 have been arranged in FIG. 1 such that their midlines (that is, virtual lines that include the room's central midpoints) are essentially aligned along the same axis C-C. However, in some embodiments, one or more rooms may instead be arranged so as to be offset with respect to the midlines of one or more other rooms. In such embodiments, a single virtual line may still be used as an acting or assumed midpoint may be used, even if not the true central midpoint of one or more rooms. Rather, the acting midpoint would represent a highest point of the roof. For example, roof 1100 of FIG. 11 is similar to roof 100 of FIG. 1, however, in FIG. 11, central room 104 has been replaced with a central room 1104 that is positioned lower in the y-axis direction, so as not to be aligned entrally around axis C-C. Nonetheless, in FIG. 11, axis C-C may function as the midline for the roof 1100, and as the basis for the ridge cap 150, even if it does not function as the midline for every respective room or for the building itself. As can be seen in FIG. 11, the panels in the top portion of room 1104 are 2U in their vertical length, which length is smaller than the vertical length of the panels in the bottom portion of room 1104 (which are 4U in length), even as the room itself maintains the same total 6U length as room 104 in FIG. 1.

Turning back to FIG. 1, a roof 100 can also include a skylight 160 with paneling/flashing elements 155. Additionally, on the end of each roof panel 110, 120, 130, 140 that does not abut the center axis (that is, the end on the edge of the roof), a gutter 170 and/or other water draining elements may be positioned and attached.

Figure 2A:
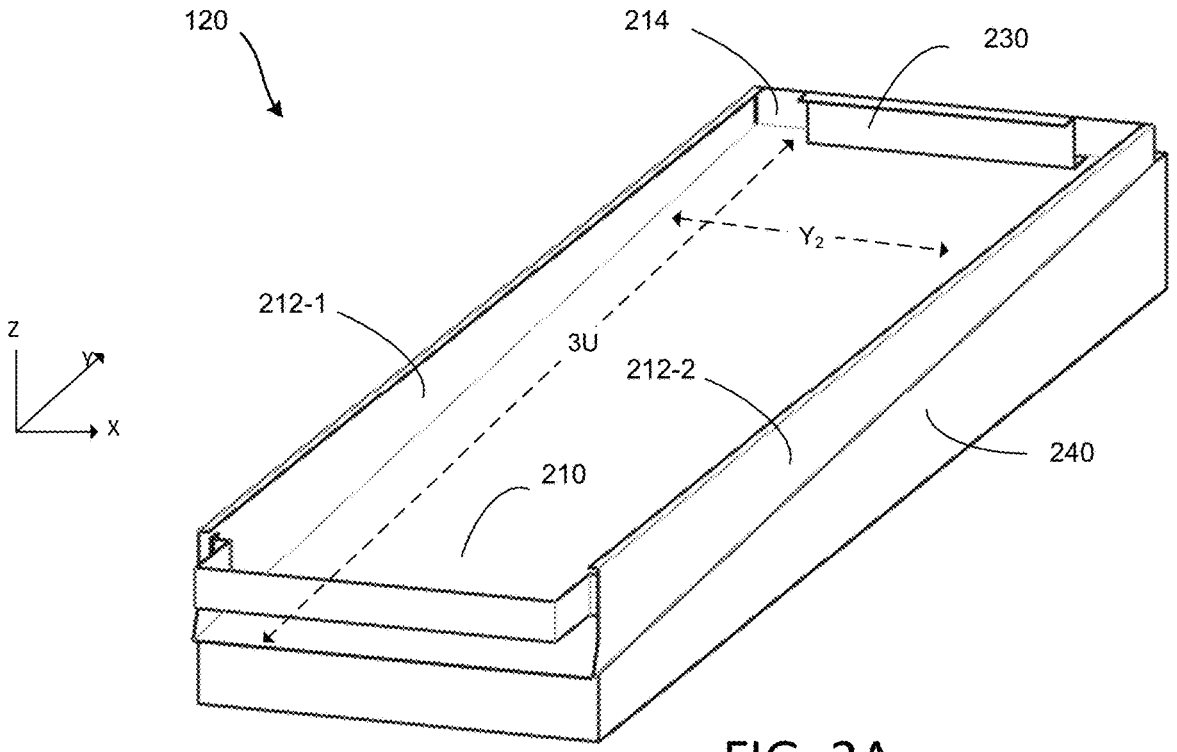
FIGS. 2A and 2B are three-dimensional perspective views of a roof panel in accordance with some embodiments of the present disclosure.
Figure 2B:
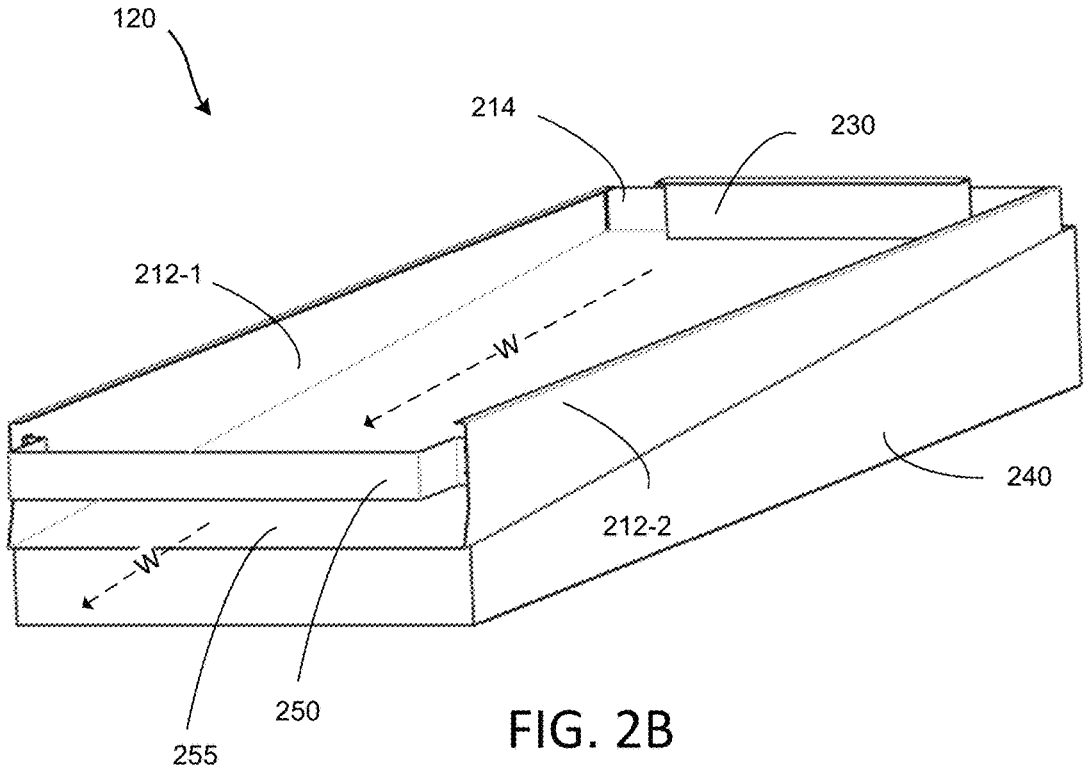

FIGS. 2A and 2B illustrate three-dimensional perspective views of a roof panel (also referred to herein as a roofing "block"). While FIGS. 2A and 2B refer to panel 120, panels 110, 130, and 140 may be understood to be generally similar in structure, though they may have different dimensions and arrangements. The exemplary roof panel 120 shown in FIG. 2A comprises a pan 210 to collect and expel water, the pan 210 positioned on top of a base 240. The pan 210 has a sloped surface bounded on its side by two vertical walls 212-1 and 212-2 that are a distance apart (in the illustrated embodiment, a distance of $Y_2$ though different embodiments may vary). In an exemplary embodiment, the pan is at least 2 inches deep (viz, 2 inches in height) to allow water to collect in case of huge storm flooding, though other dimensions are possible in other embodiments. The sloped surface of pan 210 is bounded at the top (the high end) by a back wall 214. The low end of the sloped surface is open, to allow water to drain, e.g., to a gutter. The high end of each roof panel 110, 120, 130, 140 is positioned on roof 100 so as to end at a height constant with respect to the roof beam. For instance, the measured distance (in a z-axis direction) from the bottom of the base 240 to the top of back wall 214 is the same for each of roof panels 110, 120, 130, 140, regardless of the vertical (y-axis) length of the panel, the horizontal (x-axis) width of the panel, or the slope of the sloped surface of pan 210.

As illustrated, the slope of the sloped surface of the pan is positive with respect to a horizontal axis at the base of the roof 100, such that the sloped surface is higher at the back end than at the front (gutter) end. In the exemplary embodiment, the minimum practical slope for the sloped panel is at least 2 degrees, which is the lowest slope over which water will reliably move. In one exemplary embodiment, the slope of a 4U panel may be 3.14 degrees, the slope of a 3U panel may be 4 degrees, the slope of a 2U panel may be between 5 and 6 degrees, and the slope of a 1U panel may be 9 degrees. Of course, different slopes are possible in different embodiments, based on the needs of the building below, including those necessitated by weather or seasonal needs, or based on aesthetic design, to conform the roof's style to the owner's preference, neighboring houses or architecture, and/or community standards or local or zoning ordinances. The slope of a panel is independent of the panel's width (x-axis distance) and is dependent on the length of the panel (y-axis distance). In general it may be understood that a shorter length panel is positioned at a steeper slope.

The back end 214 of the panel may include a z-clip 230 that provides a mechanism for the ridge cap to removably connect to the panel, which connection is described in greater detail herein. The exemplary z-clip 230 may variously be any size and may be attached to any position on the back wall 214, so long as that position is consistent across a plurality of roof panels, e.g., the top of the z-clip has an overhang that may be co-planar with the top of the back end 214 or may extend above or sit below the top of the back panel. The back end 214 of each roof panel 110, 120, 130, 140 ends at the same relative height from the base of the roof 100, and similarly, the z-clip 230 attached to the back panel is positioned at the same height as the z-clips of the other roof panels, to create a relatively level (or at least consistent) ridge line onto which the ridge cap can connect. In one example, the back end 214 of each panel 110, 120, 130, 140 is 50 mm high, but any height is possible so long as that height is sufficient to securely hold z-clip 230.

A base 240 of the panel 120 is, in the exemplary embodiment, made of an interior element such as a block or wedge, molded to a specific size and shape, onto which a number of metal sheets (including, e.g., one or more of a bottom sheet, a sloped surface sheet 210 (pan of the roof panel) or other top sheet, a side sheet, a back sheet, and a front sheet) are laminated. In some embodiments, one or more of the sheets may be made of a material other than metal, e.g., wood, plastic, or any other material suitable to the environment in which the roof will be used. The bottom sheet provides structural support to the interior element and intermediate roof components. In some embodiments, the bottom sheet of the panel 120 may be fixed in place, to the ceiling structure of the building below, by one or more screws (not shown). In an exemplary embodiment, the interior element of the base (interior to the metal sheets) may be constructed from low density polyurethane (e.g., ¼ inch) and plywood, however other types of insulation foam or any other appropriate material(s) may be chosen in different embodiments, suitable to the environment of the building, cost constraints, weatherproofing, level of necessary insulation, and the like. In an exemplary embodiment, the interior element may include one or more pieces of low density polyurethane constructed into a quadrilateral or other polygonal shape, though any appropriate shape is possible in other embodiments. In some embodiments, the interior element and the metal panels may be connected via an adhesive, however other possible methods of connection, such as connectors or fasteners, or mechanisms applying the bonding strength of the foam to attach foam to metal, are possible in other embodiments. In some embodiments, rather than structurally insulated roof panels (SIP), the roof panels may instead be only be made of metal sheets. Additionally, in other embodiments, the panels may not use an insulating material, and may instead select one or more materials that allow for ventilation or airflow. In other embodiments, any combination of these materials may be used.

The side walls 212-1, 212-2, back wall 214, z-clip 230, and other elements may be attached around the sloping surface of sheet 210. The illustrated side walls 212-1 and 212-2 are level on top, but in alternate embodiments, the tops of the side panels angle down, such that the side panels decrease in height as they draw closer to the edge of the building, thereby using less material. In some embodiments, one or more acrylic and/or polycarbonate rods are used to seal certain components of the panel 120. With reference to FIG. 2B, a cladding piece 250 may be attached to the front (open) end of the panel 120, the cladding functioning to hide the slight slope of the pan 210 and the back wall, to give the appearance of a relatively flat roof. Cladding piece 250 may also serve an aesthetic purpose and may be, in some embodiments, designed with various externally-facing materials of various colors, patterns and/or text. The area 255 below cladding piece 250 is an open area. Water that collects in the pan 210 may exit the roof panel 120 in the direction indicated by arrow W, through the area 255, and in some embodiments, into a gutter.

Figure 3:
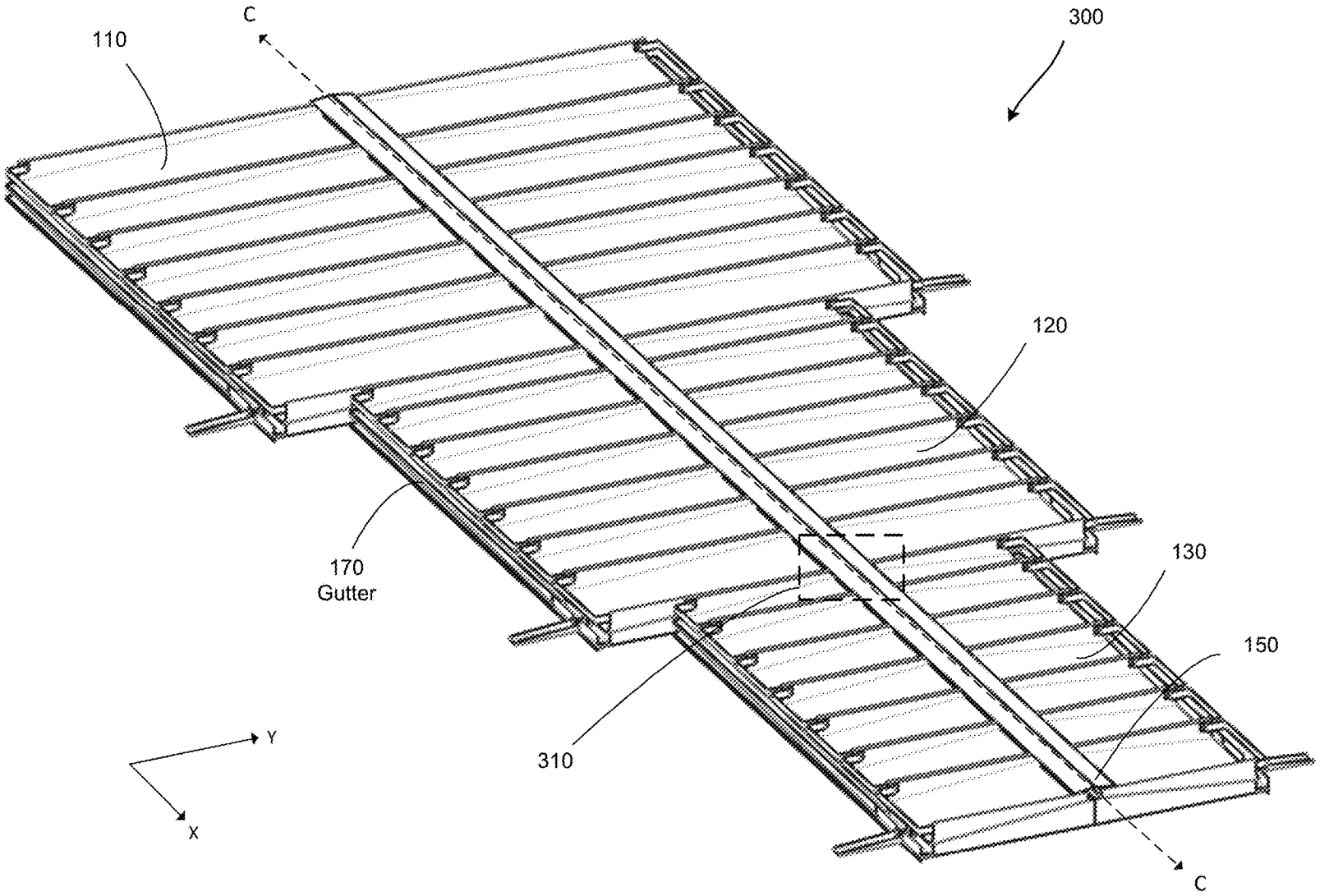
FIG. 3 is a three-dimensional perspective view of a roof in accordance with some embodiments of the present disclosure.

FIG. 3 is a three-dimensional perspective view of a roof 300 that is similar to that depicted in FIG. 1 although lacking a skylight 160 and elements corresponding thereto (e.g., no 1U panel is illustrated). As illustrated, roof panels 110, 120, and 130 are positioned so as to be horizontally adjacent (on the x-axis) to one or two other panels, regardless of their length or slope. The roof panels are also arranged so that each panel is vertically adjacent to another panel (back to back, in the y-axis direction). The roof 300 is arranged so that the back of each panel 110, 120, 130 is arranged against a central axis, such that a single "midline" C—C can be drawn down the entire roofing structure in the x-axis direction, over which the ridge cap 150 extends. Midline C-C is a single virtual line that divides each pair of panels arranged end to end, and need not represent an actual geometric midpoint to the roofing structure 300 or of the building itself.

Section 310 of FIG. 3 is an intersection of 4 panels, one pair of 3U panels 120 and one pair of 2U panels 130. At section 310, different roof panels with different slopes and lengths are positioned horizontally adjacently. In conventional implementations, at junctions of two or four components, the seam between the elements is difficult to seal completely. Rather than sealants or large sheets or pieces glued down, this sealing is done by positioning a ridge cap over the intersection, attaching the ridge cap via, e.g., a friction-based connection, and using geometry to guide water away from the seams. Exemplary cross sections of the panels bounding the intersection point 310, and the overarching ridge cap are 150 shown in FIG. 4A.

Figure 4A:
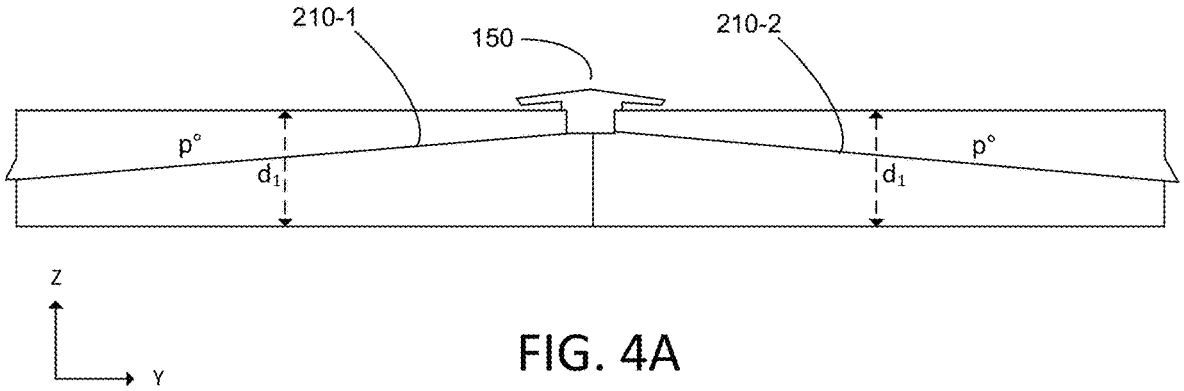
FIG. 4A is a cross-sectional view of a ridge cap as placed above two roof panels in accordance with some embodiments of the present disclosure.

FIG. 4A illustrates a cross section of two roof panels positioned back-to-back, the vertical back walls of the panels having a uniform height and length. The seam between the walls of these panels, acting as a virtual midline set at a uniform height. A ridge cap 150 (or other type of capping structure such as a gasketed gap) is arranged as a single piece over the virtual midline. In the embodiment of FIG. 4A, each of the panels in the pair has the same length, e.g., both panels may be any of 4U, 3U, 2U, 1U, etc. Additionally, each panel, regardless of its respective length, has the same z-axis (height) position as the other panels at each end, that is, the back end of each of the two panels is located at a single height, and the front (gutter) end of each of the two panels is located at another height (which may or may not be the same as the height of the back). In FIG. 4A, the height of the panels is labelled as $d_1$. Because both the height (z-axis) and the length (y-axis) distances are the same, the slope of the diagonal between the highest point and the other end of the panel will also necessarily be the same. Here, both roof panels have a sloped surface (210-1 and 210-2, respectively) positioned at a slope of p degrees.

Figure 4B:
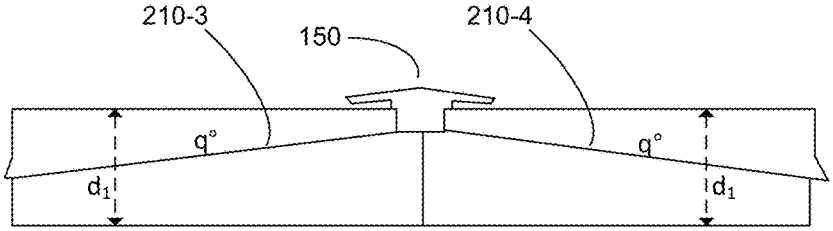
FIG. 4B is a cross-sectional view of a ridge cap as placed above two roof panels in accordance with some embodiments of the present disclosure.

FIG. 4B illustrates a connection between two panels of having uniform heights and lengths, the lengths of the panels differing from those panels illustrated in FIG. 4A (e.g., where the panels of FIG. 4A may be 3U panels, the panels of FIG. 4B may be 2U panels). Comparing FIGS. 4A and 4B, the length (y-axis distance) of the panels in FIG. 4B is shorter, while the height (z-axis distance) of the paired panels in both figures is the same, here, $d_1$. Because the sloped surfaces of the panels in FIG. 4B (210-3 and 210-4, respectively) must extend across the same vertical distance $d_1$ in a shorter diagonal distance than the panels of FIG. 4A, the sloped surfaces of the FIG. 4B panels have a value of q degrees that is different than p degrees. In particular, the slope of the surface of the panels 210-3 and 210-4 in FIG. 4B would be greater than the corresponding slopes in FIG. 4A. Therefore, surface 210-3 is steeper than 210-1. Ridge cap 150 extends along of the entirety of the seams between the back-to-back panels. Because the seam of the panels in FIG. 4A is located at the same relative height and position as that in FIG. 4B, the same ridge cap, without interruption, seam, cut, or break, can extend over both the pair of roof panels in FIG. 4A and the pair of roof panels in FIG. 4B, even if both pairs of panels with different lengths were used in the same roof.

Figure 4C:
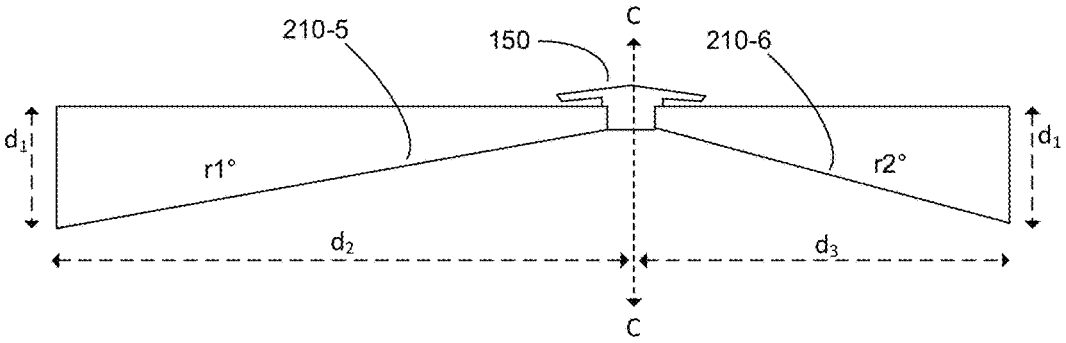
FIG. 4C is a cross-sectional view of a ridge cap as placed above two roof panels in accordance with some embodiments of the present disclosure.

FIG. 4C illustrates an embodiment (not shown in FIG. 3) where the two back-to-back panels are not the same length (y-axis distance) as each other. In the illustrated example, the left panel is a 3U panel and the right panel is a 2U panel (though any size or combination panels may be used). That is, in this embodiment, the virtual midline C-C is not at a geometric center of this portion of the roof, but rather acts as a line delineating the separation of the panels. In the exemplary figure, the roof panel on the left has a length (y-axis) distance of $d_2$ and the roof panel on the right has a length (y-axis) distance of $d_3$. As with FIG. 4A, the height of both panels is equal, here $d_1$. Because the length of the panels varies but the height is the same, the slope of the bottom surface of the respective panels (210-5 and 210-6, respectively) must necessarily change, thought it remains a positive value. The roof panel on the left is illustrated as having a surface 210-5 with a slope of $r_1$ and the roof panel on the right is illustrated as having a surface 210-6 with a slope of $r_2$, $r_2$ being greater than $r_1$. Therefore, surface 210-6 is steeper than 210-5. The ridge cap 150, positioned at the highest end of each panel, is located at the same position as in FIG. 4A. Ridge cap 150 extends along of the entirety of the seams of the panels (midline C-C). Because the seam of the panels in FIG. 4C is located at the same relative height and position as those in FIGS. 4A and 4B, the portions of the z-clips of these pairs that extend away from the back wall 114 (the overhang) are positioned so as to be consistent over several panels, that is, in a single plane (or close thereto). As a result, the same ridge cap, without interruption, seam, cut, or break, can slide over the z-clips and extend over the seams of both the pairs of roof panels in FIG. 4A and FIG. 4B, and also over the seam of the pair of roof panels in FIG. 4C, regardless of the inconsistency of length or slope. The ridge cap 150 therefore covers and contains together panels of different slopes and different lengths via a unified seal over a seam.

In alternate embodiments, the roof may be a gabled roof, with sloping sides that come together as a ridge. The ridge cap may, in these embodiments, be affixed in a similar manner, so long as a straight orthogonal line can be drawn across the roof. Accordingly, the solution herein can be applied in a highly flexible manner to any roofing structure with a "midline" regardless of slope or arrangement of panels, even where that slope changes between panels in the horizontal direction (x-axis) or in the vertical direction (y-axis). In the illustrated embodiments, so long as there is a consistent height of termination, viz., the panels are configured to meet the same predetermined or standardized height, there is a consistent object to seal to, and the panels can be sealed together regardless of their individual shape or length. In still other alternate embodiments, the back height of the first of a pair of end-to-end roof panels is not the same as the second panel of the pair, and the ridge cap fitted thereon can be angled or asymmetrical, rather than sitting orthogonally to the base of the back walls.

Figure 5:
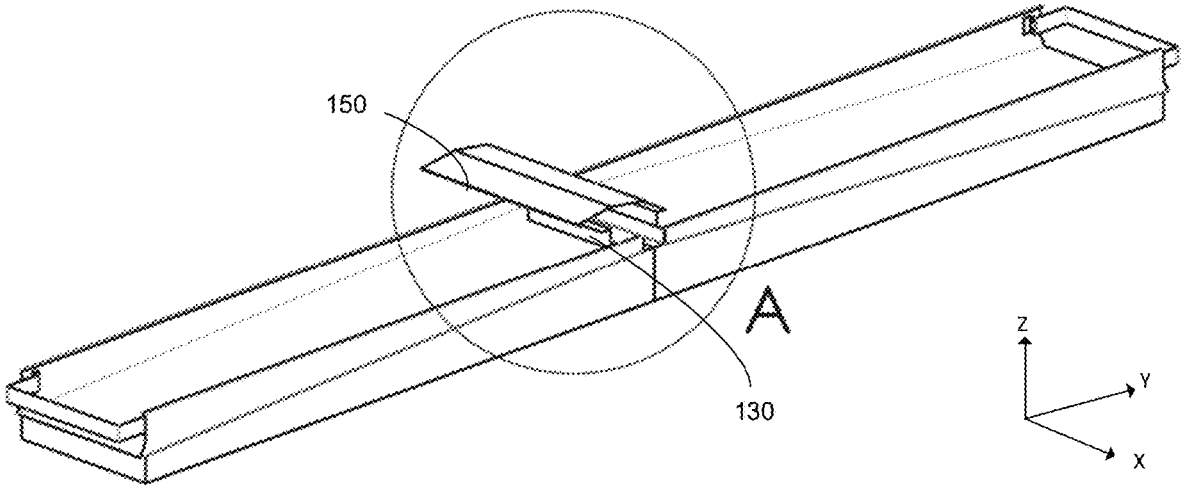
FIG. 5 is a three-dimensional perspective view illustrating placement of a ridge cap in accordance with some embodiments of the present disclosure.
Figure 6A:
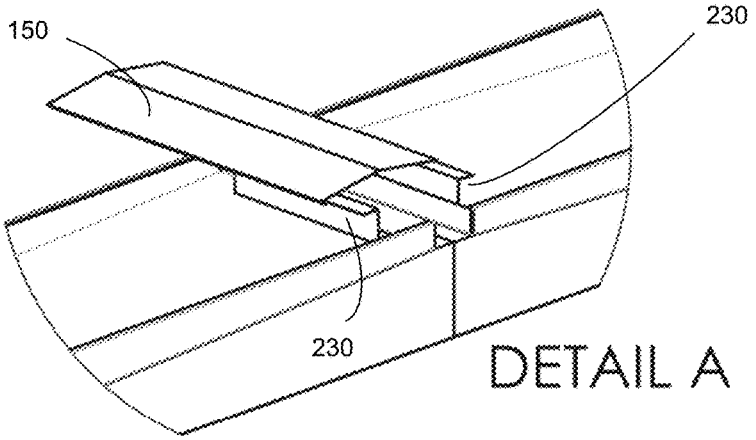
FIGS. 6A and 6B are diagrams illustrating placement of a ridge cap in accordance with some embodiments of the present disclosure.
Figure 6B:
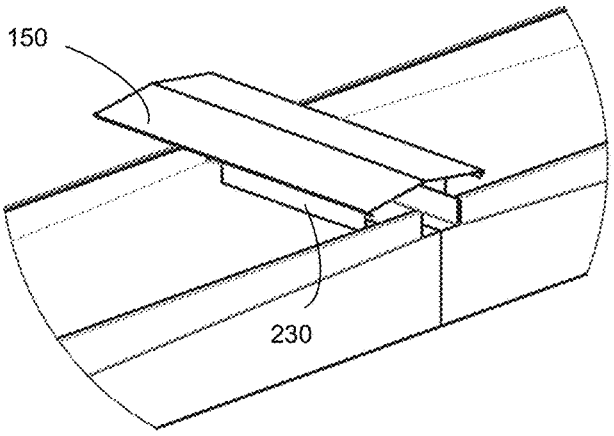

FIGS. 5, 6A, and 6B illustrates how the ridge cap 150 is fit over the z-clip 130. FIG. 5 illustrates two roof panels fit back to back, such that the back walls of the panels are adjacent. The panels have the same vertical height as each other, and each has a z-clip 130 attached to its back wall at the same relative position. At least one portion of the z-clip protrudes away from the back wall 214. In an exemplary embodiment, this protruding portion of the z-clip, or overhang, is at the top of the back wall 214, such that the back wall does not extend vertically past the z-clip's overhang, though in other embodiments, the overhang of the z-clip may sit lower against the back wall 214 or higher. In an exemplary embodiment, the overhang of the z-clip extends at a 90 degree angle away from the back wall, so as to be parallel to a base of the roofing structure 100, however, in other embodiments, the overhang may be configured to extend from the back wall at another angle (e.g., 45 degrees).

Ridge cap 150 is removably attached to the z-clips 130 by manipulating one end of the ridge cap over the z-clips 130 of a pair of roof panels at one end of the roof, and sliding the ridge cap 150 down the ridge line, so as to connect to all the z-clips (on different roof panels) on that ridge line. FIG. 5 illustrates the ridge cap 150 in the process of sliding over, such that a portion of the z-clips of the two roof panels is covered by the ridge cap, and a portion is not. FIGS. 6A and 6B zoom in on a Detail A of FIG. 5. In FIG. 6A, the ridge cap 150 is in the same position as in FIG. 5. In FIG. 6B, the ridge cap has been slid over to cover the entirety of the z-clip 130, at which point the ridge cap is affixed to the z-clip. In alternate embodiments, rather than sliding, ridge cap 150 may be snapped on the overhang of the z-clip 130, bent or deformed so as to fit around the overhang, or otherwise attached.

Figure 7A:
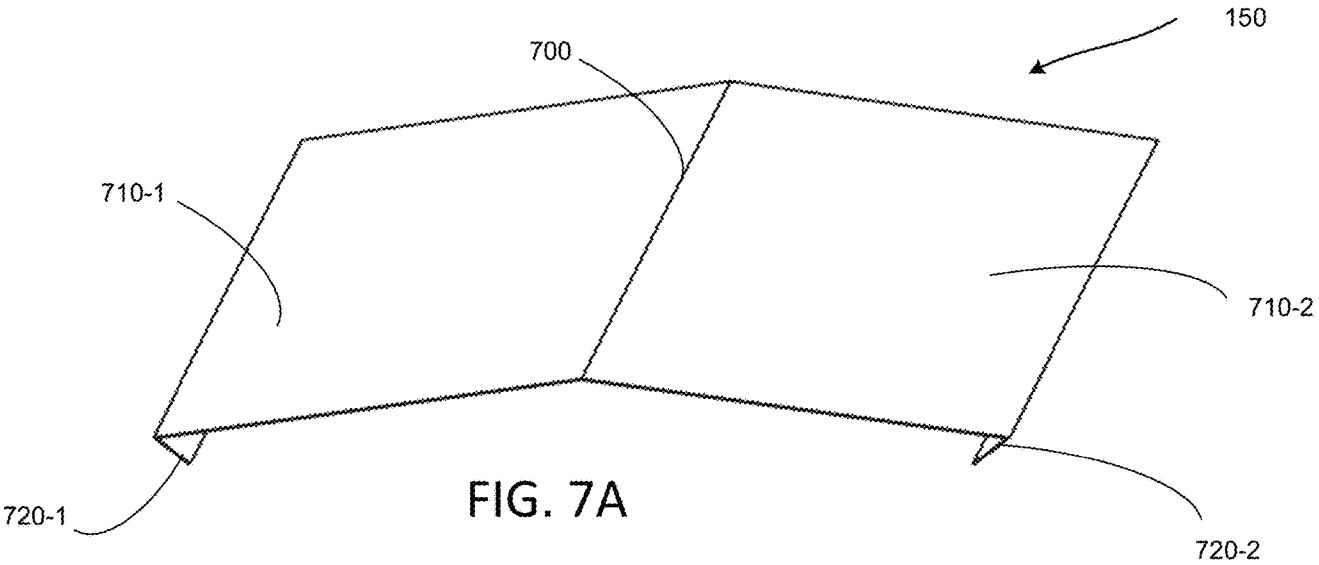
FIG. 7A is a three-dimensional perspective view of a ridge cap in accordance with some embodiments of the present disclosure.

FIG. 7A is a three-dimensional view of the ridge cap 150. A ridge cap 150 (or other type of capping structure) is arranged as a single piece over the virtual midline, so as to cover the seam between roof panels when they are arranged back to back. In an exemplary embodiment, the ridge cap is a single piece of metal, bent at three positions to form a roughly diamond-shaped structure. From a center ridge 700, two outwardly-angled extensions 710-1 and 710-2 extend downward. From the end of the extensions 710-1 and 710-2, two inwardly-angled extensions 720-1 and 720-2, respectively, extend downward towards the center ridge 700. The outward and downward placement of extensions 710-1 and 710-2 guide water away from the center ridge 700, towards the pans 210 of the roof panels, and ultimately, off the roof and, in some embodiments, into a gutter. The inward and downward placement of extensions 720-1 and 720-2 lock the ridge cap in a location relative to the z-clips 130, so that the ridge cap is held in place by friction and cannot easily fall (or be wind blown) off of the z-clips onto either side of the roofing structure. The various extensions of the ridge cap may also be referred to herein as "panes".

The particular length, slope, and placement of extensions 710-1, 710-2, 720-1, and 720-2 may vary in different embodiments, however, certain geometric features must be met for the ridge cap to guide water away from the z-clips and into the pan 210 without encroachment of water back into the seams between the roof panels. Initially, the top of the ridge cap 150, center ridge 700, must be elevated enough from the pan 210 that water will slide off of the ridge cap 150, into the pan, and out of the sloped surface of the roof panel. In an exemplary embodiment, this requires outwardly-angled extensions 710-1 and 710-2 to be non-flat, with a slope of at least 2 degrees downward to allow water to flow down the slope. In this capacity, ridge cap 150 may be understood to function along the lines of a pitched or gabled roof.

Figure 7B:
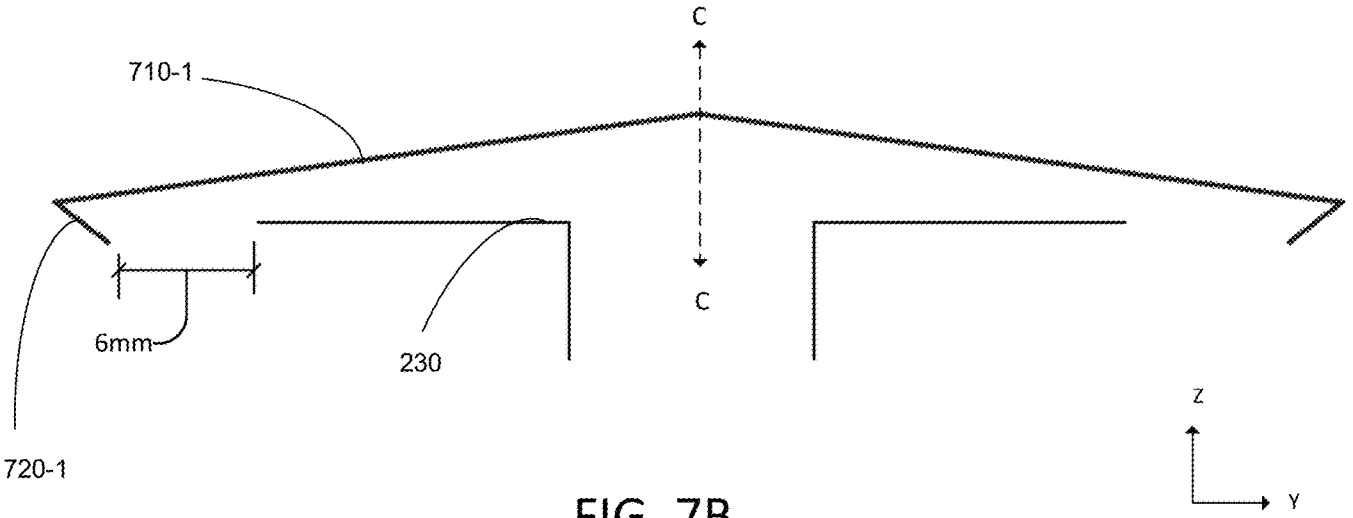
FIG. 7B is a cross-sectional view of a ridge cap in accordance with some embodiments of the present disclosure.

Further, with reference to FIG. 7B, the end of the ridge cap, that is, the end of the inwardly-angled extensions 720-1 and 720-2, must terminate at a point sufficiently far from the overhang of z-clip 230 so as to create a capillary break between the ridge cap 150 and the z-clip 130. This capillary break prevents moisture migration from water on the ridge cap into the seam between the panels. In some embodiments, the necessary length of the capillary break may depend upon a predetermined temperature and pressure. For example, at most normal temperatures and pressures, the size of a single molecule of water crawling up a wall is roughly 5 mm wide, the gap between the ridge cap and the overhang of the z-clip must be greater than 5 mm in size. In an exemplary embodiment, the size of the gap is 6 mm. If the gap between those components is smaller than 5 mm, then it is possible that the surface strength of water may also the water to bridge the gap and continue along the overhang of the z-clip and into the seam between the roof panels, that is, the surface strength of water lets it continue up the side due to capillary action. Therefore, keeping a distance of at least 1 mm more creates a capillary break to prevent water from crawling up. The ridge cap and z-clip may be configured to create a gap of a different length as necessary to accommodate expected ranges of environmental temperature and pressure changes. Additionally, both of extensions 710-1, 710-2 and extensions 720-1, 720 are angled down with respect to the topmost portion of the ridge cap, central seam 700, so as to facilitate the use of gravity to direct water downward into the pan 210 of the panels and prevent the water from entering between the panels. In this capacity, ridge cap 150 may be understood to function along the lines of a standing seam.

Figure 8A:
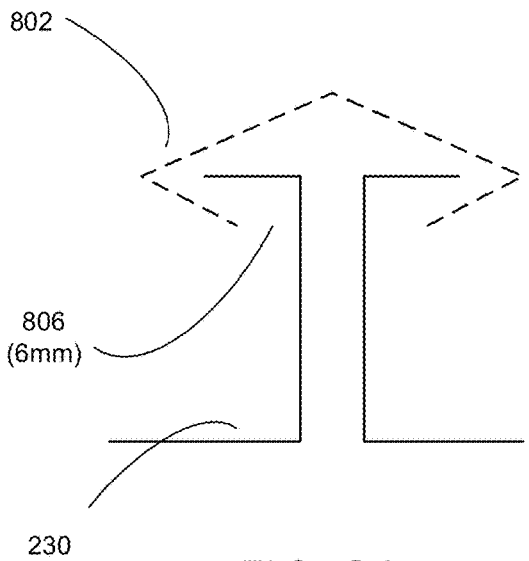
FIG. 8A is a cross-sectional view of a ridge cap in accordance with some embodiments of the present disclosure.
Figure 8B:
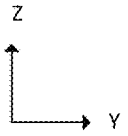
FIG. 8B is a cross-sectional view of a ridge cap in accordance with some embodiments of the present disclosure.
Figure 8B:
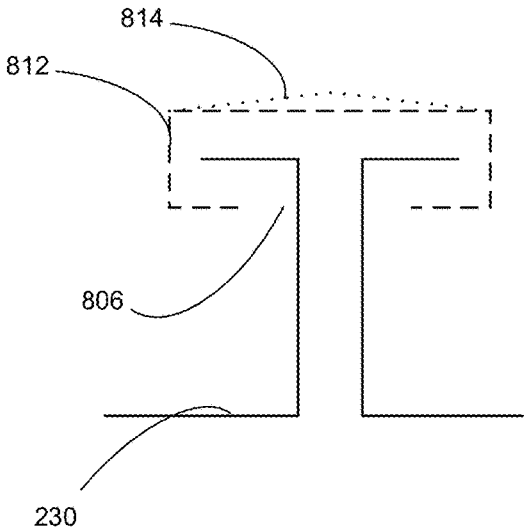
Figure 8C:
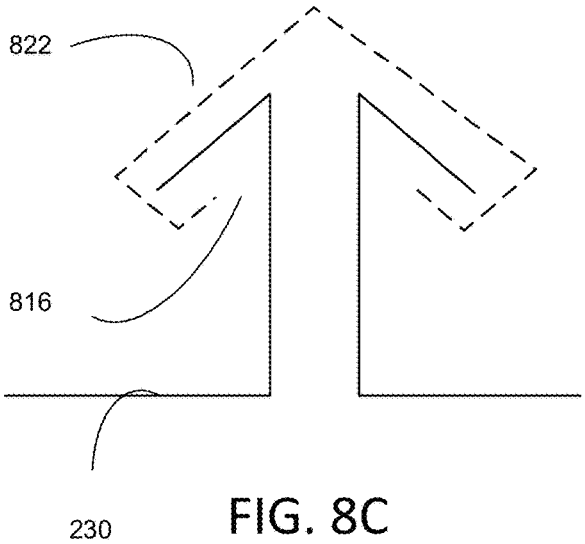
FIG. 8C is a cross-sectional view of a ridge cap in accordance with some embodiments of the present disclosure.

The ridge cap is not limited to a diagonal shape as shown in FIGS. 7A and 7B. FIGS. 8A-C illustrated several exemplary shapes of the ridge cap 150 and/or the z-clips 130, each depicting a way to seal with different geometry. FIG. 8A illustrates a diamond-shaped ridge cap, as described above, fit over a T-shaped overhang of the z-clip 130. As shown, extension 802 is angled downward, first outwardly then inwardly, leaving a gap 806 sufficiently large to create a capillary break. FIG. 8B illustrates a right-angled or rectangularly-shaped ridge cap with an extension 812 (shown in dashed lines) that is flat across the top, angles downward at a 90 degree angle, and then angles inward at a 90 degree angle, leaving a gap 806 sufficiently large to create a capillary break. In an alternate embodiment (indicating by dotted lines 814), the top of the ridge cap may be sloped downward to further use gravity to direct water away from the center of the ridge cap. FIG. 8C illustrates an angled ridge cap similar to that of FIG. 8A, except, in the embodiment of FIG. C, the extension of the ridge cap 822 is first angled outwardly and downward, then inwardly and downward, and lastly inwardly and upward, leaving a gap 816 sufficiently large to create a capillary break with an overhang of z-clip 230 which, in this embodiment, is positioned at an angle rather than orthogonal. The final, inward and upward orientation of the extension 822 creates a point at which water would have to fight against gravity to reach the termination point of the ridge cap. Of course, the ridge cap 150 is not limited to any of these shapes, and other configurations may be possible in other embodiments.

In general, it may be understood that in the exemplary embodiment, the ridge cap 150 is positioned to touch the overhang of the z-clip so as to be fixed into place by friction, to extend away from the back wall of a roof panel to create a capillary break, and to, at its topmost point, be angled enough to direct water in the pan of the roof panel below.

In still other embodiments (not shown), a complex geometry may be used for ridge cap 150, in the manner of any known standing seam roof, to direct the flow of water into one particular location, e.g., into a gutter/spout. Such an embodiment would be most useful where the building has a particular orientation, is asymmetrical or uniquely configured in shape, or is located on a slope, hill, or uneven terrain, such that water should be directed to a particular location on the building. In other implementations, these directional results may be achieved using any of the embodiments of the ridge caps shown in FIGS. 8A-8C, while using a gutter system that directs water flow to a specific desired location.

Figure 9A:
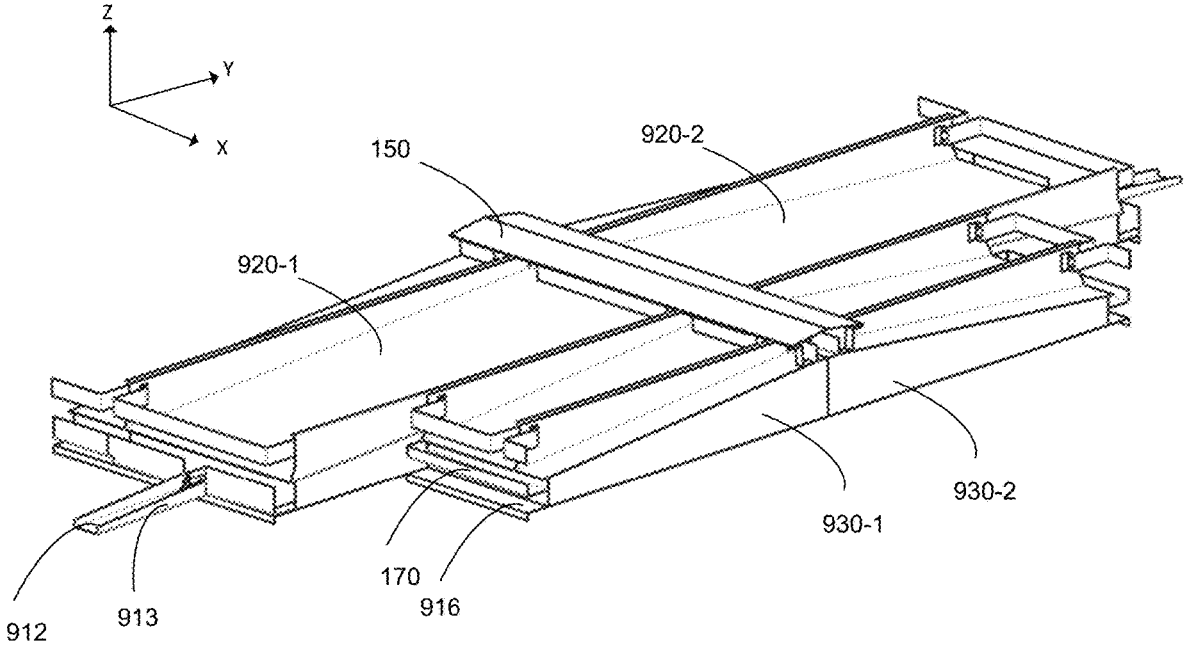
FIGS. 9A and 9B are three-dimensional perspective views of four adjacent roof panels in accordance with some embodiments of the present disclosure.
Figure 9B:
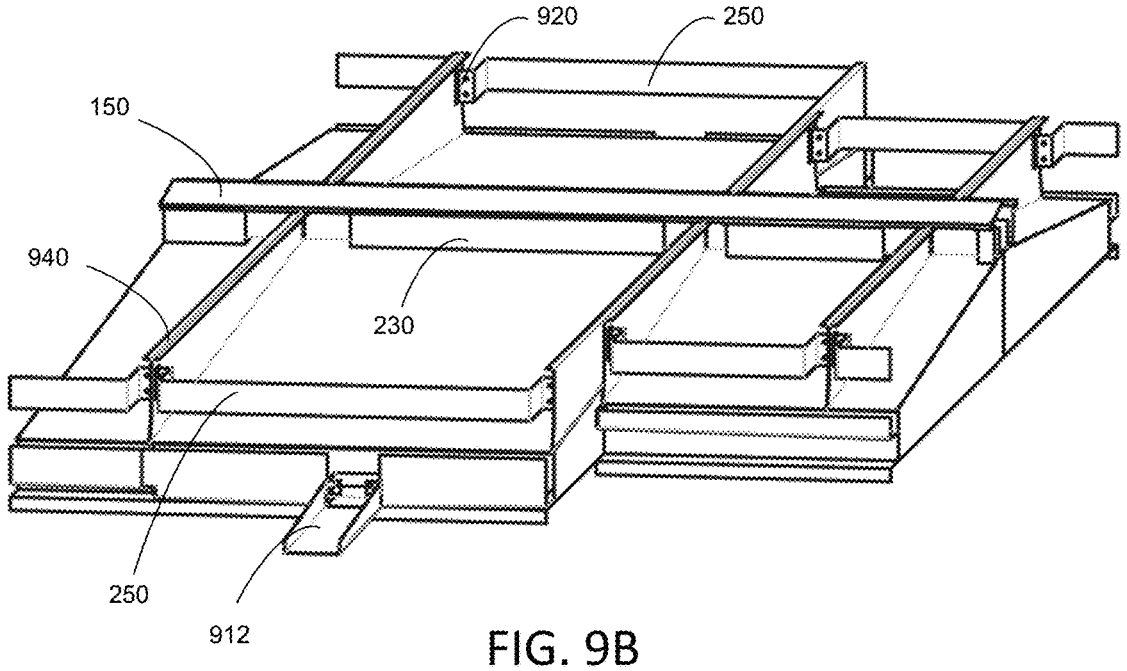

FIGS. 9A and 9B depict four roof panels surrounding the intersection point 310 shown in FIG. 3. FIGS. 9A and 9B depict two 3U panels (920-1 and 920-2) arranged back to back and respectively horizontally adjacent to two 2U panels (930-1 and 930-2) though other embodiments may use any type of size or configuration of roof panel. As can be seen, each of panels 920-1, 920-2, 930-1, and 930-2 have a back wall with the same height, creating a level seam over which ridge cap 150 may be positioned. Because of the uniform seam that exists even between horizontally adjacent panels of different sizes and slopes, a single, unbroken ridge cap can be used to guide water into the pans of the respective panels.

FIG. 9B illustrates the connection of cladding 250 to the side wall 212-1, 212-2 of a roof panel. In particular, a set of screws 920 may be used to connect the cladding to the side panel. Additionally, in some embodiments, sealing components such as acrylic or polycarbonate rods 940 may be slid over the junctions 530 between horizontally-adjacent panels. In other embodiments, these junctions 530 may be sealed with one or more capping structures attached on the outside edges of the side walls bounding the junction (not shown).

FIGS. 9A and 9B also depict various components used to direct water after it flows out of the sloped surface of the roof panel at any speed. In particular, the illustrated roof structures may have one or more gutters 170 and/or scuppers 913 around the perimeter of the roof pans into which water collects. Any of the gutters and scuppers may be attached or connected to the roof panels 110, 120, 130, 140. Spouts 912 may be fastened to the scuppers, the spouts extending beyond the edge of the building, and direct water at a given distance away, completing the water path away from the building. In an alternate embodiment, none of the gutters, scuppers, or spouts are used, and the water flows directly out of the openings 255 onto the area or ground below.

In addition, the roof may have or more flashing elements/drip edge elements 916 around the perimeter of the roof that prevent water from seeping under the roofing. A flashing element 916 may include at least one piece of a solid material that hangs over the edge of the roof panels 110, 120, 130, 140, using gravity to direct water downwards, thereby preventing water from entering above or below. Flashing elements may also be used at the top vertical end of one or more panels (not specifically shown). In some embodiments, flashing 916 is shiplapped with the joint below, to create a tight seal that might otherwise allow water expelled by the flashing element to travel back up. In other embodiments, 23 butyl tape may be used to create a watertight seal between the roof panels and the walls or wall panels of the building below. In various embodiments, any of gutters 170, scuppers 513, spouts 512, and/or flashing elements 516 may be made of plastic, roofing felt, rubber, or rust-resistant metal such as galvanized steel, aluminum, or copper, though other embodiments may use other materials in any appropriate shape. In some embodiments (not specifically shown), each roof block, or the roofing as a whole, may include one or more shingles to repel water, protect the roof, and/or provide aesthetic value, other decorative elements, and/or ventilation elements to circulate air or encourage air flow.

Figure 10A:
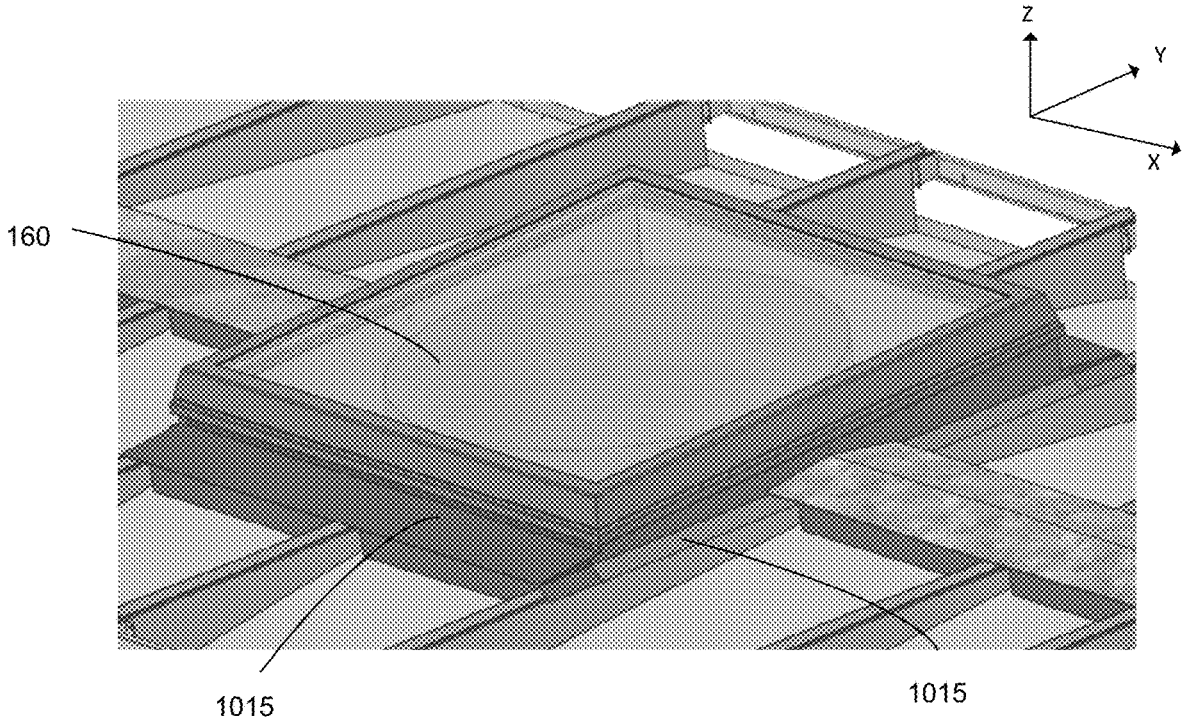
FIG. 10A is a three-dimensional perspective view of a skylight installed between roof panels in accordance with some embodiments of the present disclosure.
Figure 10B:
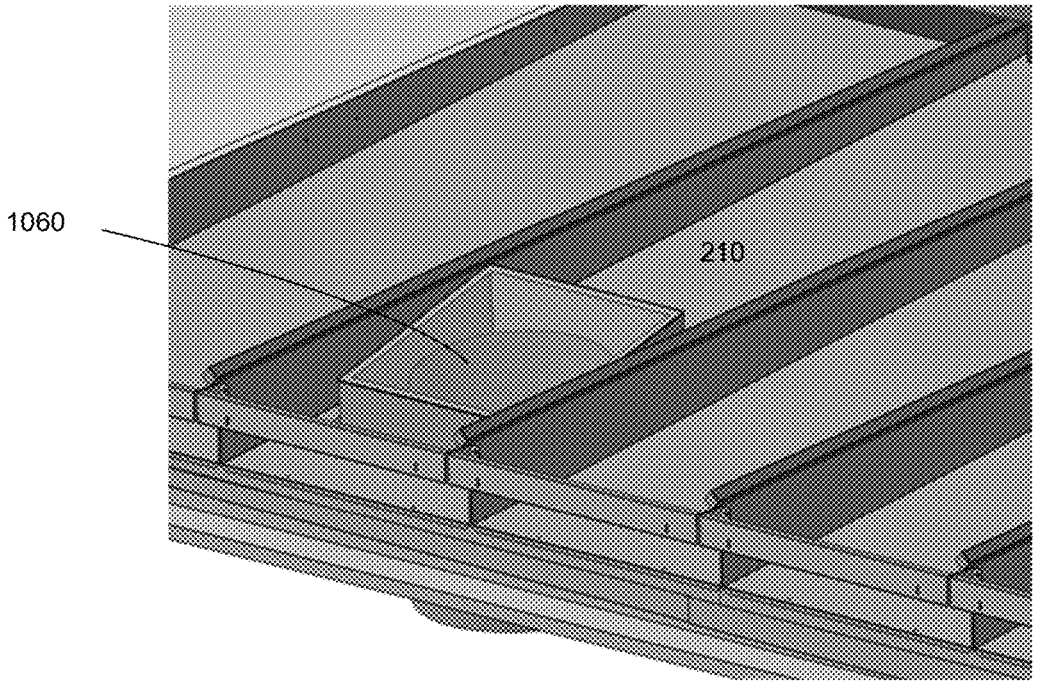
FIG. 10B is a three-dimensional perspective view of a skylight installed within a roof panel in accordance with some embodiments of the present disclosure.

FIG. 10A, 10B illustrate two exemplary types of skylights that may be installed in the roofing structure 100. FIG. 10A depicts a freestanding skylight 160 that is positioned to intersect or form a junction with more than one roof panel. FIG. 10B depicts a skylight 1060 built into a roof panel (with reference to FIG. 1, a 4U roof panel 110, though any sufficiently sized roof panel may be used in other embodiments). One or more flashing elements 1015 may be used to prevent water from getting into or under the skylights. While heavy wind/rain may drive water towards the joins of the skylight, the height of the flashing 1015 should be sufficient to block the passage of the water up the flashing and into the skylight.

By virtue of the features described above and in FIGS. 1 through 11, a modular, modifiable and/or removable roofing structure that is impervious to water may be implemented. The roofing structure is highly flexible in design, providing a single uniform seam across a midline between roof panels that can be covered and sealed, regardless of the slope or length of those panels. Still further, although the ridge cap can be applied to highly-customized installations of roof panels, the structural components of the roof are highly modular, and are not permanently affixed. Rather, the roof can be disassembled without structural damage to component parts, and reassembled into different configurations, allowing for reuse, reconfiguration, and/or recycling of those parts in a replacement or alternate structure. More particularly, component parts of the roofing structures described herein are connected through temporary means (e.g., detachable) in a manner that does not cause physical damage to any component, such as fasteners like bolts, screws, rivets or through methods like insertion. No "permanent" mechanism of affixing, that is, those that might damage the components or materials, like nails, self-drilling screws, glue, sealants, melting/structural alteration, beveling, cuts, or other "permanent" alterations are made or added during the construction of the roofs described herein. In the exemplary embodiments described herein, the attachment points to the roof below are simple metal on metal connections, viz., a mechanical seal rather th sealant. By removing the panels, gutters, and other pieces, the structure will be disassembled. This is in stark contrast to previous solutions, in which sealant may need to be melted by a blowtorch or cut away. As a result, after the intended period of use of the roofing structure described herein, the component materials themselves have experienced minimal wear and tear, and are in a condition for reuse. Because of the reusability of the component parts, high-quality materials may be used, thereby improving the durability of the material and their weather and/or environment fitness.

Further, the exemplary roof structure provides a building with a visually flat roof while serving, in a small package, to drain all the water away from the top of the building. Water encroach is prevented through the use of gravity and of natural (e.g., geometric) solutions to guide water away from problematic spaces, such as seams or junctions of the roof. As a result, the exemplary roof seal uses no extra parts (to eliminate water seepage) and provides aesthetic appeal while keeping a structure that can be disassembled without damage.

The foregoing is merely illustrative of the principles of this disclosure and various modifications may be made by those skilled in the art without departing from the scope of this disclosure. The above described embodiments are presented for purposes of illustration and not of limitation. The present disclosure also can take many forms other than those explicitly described herein. Accordingly, it is emphasized that this disclosure is not limited to the explicitly disclosed methods, systems, and apparatuses, but is intended to include variations to and modifications thereof, which are within the spirit of the following claims.

As a further example, variations of apparatus or process parameters (e.g., dimensions, configurations, components, process step order, etc.) may be made to further optimize the provided structures, devices and methods, as shown and described herein. In any event, the structures and devices, as well as the associated methods, described herein have many applications. Therefore, the disclosed subject matter should not be limited to a single embodiment described herein, but rather should be construed in breadth and scope in accordance with the appended claims.

What is claimed is:

1. A roofing structure comprising:

a first roof panel having (a) a first bottom sheet, (b) a first side sheet and a second side sheet, the first side sheet and the second side sheet being positioned at opposite sides of the first bottom sheet, and (c) a first back wall connecting the first side sheet, the second side sheet, and the first bottom sheet, wherein the first bottom sheet is positioned so as to be angled at a first slope, a vertically-highest side of the first bottom sheet being at an intersection of the first bottom sheet with the first back wall, and wherein a vertical distance from a vertically-lowest portion of the first bottom sheet to a vertically-highest portion of the first back wall is of a first height;

a second roof panel having (a) a second bottom sheet, (b) a third side sheet and a fourth side sheet, the third side sheet and the fourth side sheet being positioned at opposite sides of the second bottom sheet, and (c) a second back wall connecting the third side sheet, the fourth side sheet, and the second bottom sheet, wherein the second bottom sheet is positioned so as to be angled at a second slope that is different than the first slope, a vertically-highest side of the second bottom sheet being at an intersection of the second bottom sheet with the second back wall, and wherein a vertical distance from a vertically-lowest portion of the second bottom sheet to a vertically-highest portion of the second back wall is of the first height; and a ridge cap;

wherein the first roof panel and the second roof panel are positioned adjacent to each other, the first roof panel and the second roof panel being separated by a gap, and wherein the ridge cap is positioned so as to seal the gap between the roof panels.

2. The roofing structure of claim 1, wherein the first bottom sheet has a first length, and the second bottom sheet has a second length that is different than the first length.

3. The roofing structure of claim 1, wherein an external side of the back wall of the first roof panel is positioned so as to face an external side of the back wall of the second roof panel, wherein the ridge cap is positioned so as to cover the gap between the roof panels, the gap being a gap between the external side of the back wall of the first roof panel and the external side of the back wall of the second roof panel, wherein the ridge cap comprises a first pane extending from a first position above the gap between the roof panels to a second position that is above the first bottom sheet of the first roof panel, at a vertical height that is lower than the first height, and at a horizontal distance from the back wall of the first roof panel that is greater than a length sufficient to create a capillary break for water at a predetermined temperature and pressure, and wherein the ridge cap further comprises a second pane extending from the second position to a third position that is above the first bottom sheet of the first roof panel, at a vertical height that is lower than the vertical height of the second position, and is located horizontally closer to the back wall of the first roof panel than the second position.

4. The roofing structure of claim 1, further comprising:

a z-shaped clip attached to the back wall of the first roof panel, wherein the z-shaped clip has an overhang that extends away from the back wall of the first roof panel, and wherein the ridge cap is positioned such that the first pane of the ridge cap extends to a position farther from the back wall of the first roof panel than a termination point of the overhang of the z-shaped clip, and the second pane of the ridge cap extends to a position closer to the back wall of the first roof panel than the termination point of the overhang of the z-shaped clip.

5. The roofing structure of claim 1, further comprising:

a gutter attached to the vertically-lowest portion of the first bottom sheet of the first roof panel.

6. A roofing structure comprising:

a first roof panel having (a) a first back wall, and (b) a first bottom sheet positioned at an angle, wherein a vertically highest end of the first bottom sheet is attached to the first back wall, wherein the height of the first back wall is a first height;

a second roof panel having (a) a second back wall, and (b) a second bottom sheet positioned at an angle, wherein a vertically highest end of the second bottom sheet is attached to the second back wall, wherein the height of the second back wall is the first height;

a ridge cap; and a z-clip attached to the back wall of the first roof panel, wherein the z-clip has an overhang that extends away from the back wall of the first roof panel, wherein the first roof panel and the second roof panel are positioned such that the first back wall of the first roof panel is adjacent to the second back wall of the second roof panel, and wherein the ridge cap is positioned so as to cover the first back wall of the first roof panel and the second back wall of the second roof panel.

7. The roofing structure of claim 6, wherein a length of the first bottom sheet is equal to a length of second bottom sheet.

8. The roofing structure of claim 6, wherein the first bottom sheet is angled at a first slope and the second bottom sheet is angled at a second slope different from the first slope.

9. The roofing structure of claim 6, wherein an external side of the back wall of the first roof panel is positioned so as to face an external side of the back wall of the second roof panel, wherein the ridge cap comprises a first pane extending from (a) a first position above a gap between the external side of the back wall of the first roof panel and the external side of the back wall of the second roof panel to (b) a second position that is above the first bottom sheet of the first roof panel, at a vertical height that is lower than the first height, and wherein the second position is located at a horizontal distance from the back wall of the first roof panel that is sufficient to create a capillary break.

10. The roofing structure of claim 6, further comprising:

a z-clip attached to the back wall of the first roof panel, wherein the z-clip has an overhang that extends away from the back wall of the first roof panel, wherein the ridge cap is detachably coupled to the z-clip.

11. The roofing structure of claim 6, wherein the second position is located at a distance from the overhang from the z-clip that is sufficient to create a capillary break.

12. The roofing structure of claim 6, further comprising:

a z-clip attached to the back wall of the first roof panel, wherein the z-clip has an overhang that extends away from the back wall of the first roof panel, wherein the ridge cap further comprises a second pane extending from the second position to a third position that is above the first bottom sheet of the first roof panel, at a vertical height that is lower than the vertical height of the second position, and located horizontally closer to the back wall of the first roof panel than the second position, wherein the second position of the ridge cap is located farther from the back wall of the first roof panel than a termination point of the overhang of the z-clip, and wherein the third position the ridge cap is located closer to the back wall of the first roof panel than the termination point of the overhang of the z-clip.

13. A roofing structure comprising:

a ridge cap;

a first roof panel having (a) a first bottom sheet positioned at an angle, (b) a first side sheet and a second side sheet, the first side sheet and the second side sheet being positioned at opposite sides of the first bottom sheet, and (c) a first back wall connecting the first side sheet, the second side sheet, and the first bottom sheet, wherein a vertically highest end of the first bottom sheet is attached to the first back wall;

a second roof panel (a) a second bottom sheet positioned at an angle, (b) a third side sheet and a fourth side sheet, the third side sheet and the fourth side sheet being positioned at opposite sides of the second bottom sheet, and (c) a second back wall connecting the third side sheet, the fourth side sheet, and the second bottom sheet, wherein a vertically highest end of the second bottom sheet is attached to the second back wall, and wherein the first roof panel and the second roof panel are positioned such that the first back wall of the first roof panel is adjacent to the second back wall of the second roof panel;

a third roof panel having (a) a third bottom sheet positioned at an angle, (b) a fifth side sheet and a sixth side sheet, the fifth side sheet and the sixth side sheet being positioned at opposite sides of the third bottom sheet, and (c) a third back wall connecting the fifth side sheet, the sixth side sheet, and the third bottom sheet, wherein a vertically highest end of the third bottom sheet is attached to the third back wall, and wherein the first roof panel and the third roof panel are positioned such that one of the first side sheet or the second side sheet the first roof panel is adjacent to one of the fifth side sheet or the sixth side sheet of the third roof panel;

a fourth roof panel having (a) a fourth bottom sheet positioned at an angle, (b) a seventh side sheet and an eighth side sheet, the seventh side sheet and the eighth side sheet being positioned at opposite sides of the fourth bottom sheet, and (c) a fourth back wall connecting the seventh side sheet, the eighth side sheet, and the fourth bottom sheet, wherein a vertically highest end of the fourth bottom sheet is attached to the fourth back wall, wherein the third roof panel and the fourth roof panel are positioned such that the third back wall of the third roof panel is adjacent to the fourth back wall of the fourth roof panel, and wherein the second roof panel and the fourth roof panel are positioned such that one of the third side sheet or the fourth side sheet of the second roof panel is adjacent to one of the seventh side sheet or the eighth side sheet of the fourth roof panel, and a z-clip attached to the back wall of the first roof panel, wherein the z-clip has an overhang that extends away from the back wall of the first roof panel, wherein a vertical height of each of the fourth back wall of the first roof panel, the second back wall of the second roof panel, the third back wall of the third roof panel, and the first back wall of the fourth roof panel are a first height, wherein a respective exterior side of each of the respective back walls of each of the first roof panel, second roof panel, third roof panel, and fourth roof panel abuts a central axis, wherein the ridge cap is positioned over the central axis so as to cover the respective back walls of each of the first roof panel, the second roof panel, the third roof panel, and the fourth roof panel, and wherein the ridge cap is detachably coupled to the z-clip.

14. The structure of claim 13, wherein a length of the first bottom sheet of the first roof panel is different than a length of the second bottom sheet of the second roof panel.

15. The structure of claim 13, wherein a length of the first bottom sheet of the first roof panel is different than a length of the third bottom sheet of the third roof panel.

16. The roofing structure of claim 13, wherein the first bottom sheet is angled at a first slope and the second bottom sheet is angled at a second slope different from the first slope.

17. The roofing structure of claim 13, wherein the first bottom sheet is angled at a first slope and the third bottom sheet is angled at a slope different from the first slope.

* * * * *